US005994686A

United States Patent [19]

Salina

[11] Patent Number: 5,994,686

[45] Date of Patent: Nov. 30, 1999

[54] MICROWAVE HEAT-TREATING DEVICE WITH CONCAVE REFLECTORS

[75] Inventor: Réné Salina, Abtwiehl, Switzerland

[73] Assignee: Riedhammer GMBH, Nurnberg, Germany

[21] Appl. No.: 08/776,302

[22] PCT Filed: Jul. 15, 1994

[86] PCT No.: PCT/DE94/00819

§ 371 Date: Jan. 15, 1997

§ 102(e) Date: Jan. 15, 1997

[87] PCT Pub. No.: WO96/02802

PCT Pub. Date: Feb. 1, 1996

[51] Int. Cl.[6] ..... H05B 6/80

[52] U.S. Cl. ..... 219/745; 219/756; 219/701; 219/750

[58] Field of Search ..... 219/756, 745, 219/746, 748, 747, 750, 728, 695, 696, 700, 701

[56] References Cited

U.S. PATENT DOCUMENTS

| | | | |
|---|---|---|---|
| 2,543,053 | 2/1951 | Parker | 219/748 |
| 3,281,727 | 10/1966 | Niebuhr et al. | 219/748 |
| 4,631,380 | 12/1986 | Tran | 219/748 |
| 5,498,857 | 3/1996 | Jacquault | 219/745 |
| 5,532,462 | 7/1996 | Butwell et al. | 219/695 |

FOREIGN PATENT DOCUMENTS

| | | | |
|---|---|---|---|
| 40 32 496 | 4/1991 | Germany . | |
| 63-294685 | 12/1988 | Japan | 219/745 |
| 4-137391 | 5/1992 | Japan | 219/745 |

*Primary Examiner*—Philip H. Leung

*Attorney, Agent, or Firm*—John F.A. Earley; John F.A. Earley, III; Harding, Earley, Follmer & Frailey

[57] ABSTRACT

The invention relates to a device for heat treating products by microwave radiation with a heating chamber to take the products in which the microwaves (16) can be coupled to a device (12) in the heating chamber (2) and the heating chamber (2) has at least one wall (13) which reflects the microwaves (16).

1 Claim, 1 Drawing Sheet

Figure 1:
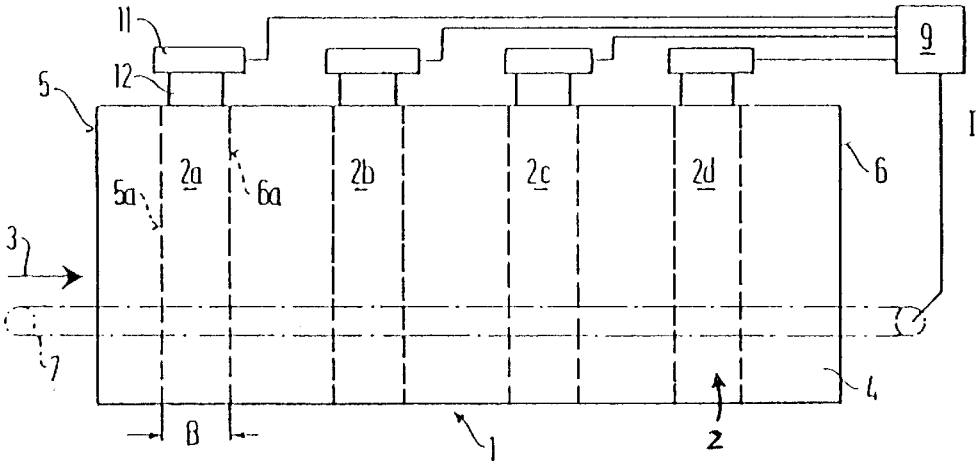

9
6
4
2d
2c
2b
2a
6a
5a
11
12
5
3
7
1
2
B 21
13,13c
4
16
14
15
13,13b
c
b
III
13,13a 16
13
14
8
7

16
13,13c
14
21
15
8
7
13,13b
13,13a 18
6a
16b
RE
13
14
16a
16
a
2a
5a
B

MICROWAVE HEAT-TREATING DEVICE WITH CONCAVE REFLECTORS

The present invention pertains to a device for heat-treating products by microwave radiation with a heating chamber for accommodating the products, wherein the microwaves can be coupled into the heating chamber by a device, and the heating chamber has at least one reflecting wall reflecting the microwaves.

Such a device (hereinafter also called furnace) has been known for drying, heating or firing (sintering) a great variety of products.

Difficulties arise if the physical/mechanical properties of the products change during heating, which happens, e.g., during the heating and firing of ceramic products. The term "ceramic products" comprises all types of prior-art ceramic materials, e.g., porcelain, but also special ceramic products, such as carbon products, ferrites, or refractory ceramic products.

Devices of the class described in the introduction have become known to date predominantly as so-called intermittently operating furnaces, in which the products are introduced into the heating space, which is subsequently closed (DE-B 1 097 594). The furnace, which is spherical according to DE-B 1 097 594, is again opened after the heat treatment, and the products are removed.

However, there also are continuously operating furnaces, especially for industrial production, such as tunnel furnaces, in which the products are guided to a furnace outlet via a furnace inlet on a conveying device. The products are heat-treated, e.g., initially heated up, then fired (sintered), and subsequently cooled again, on their way through the heating chamber.

Such a device is described in FR-A 911 170. The furnace has a tubular shape. A likewise tubular reflecting wall with radially arranged devices for coupling microwaves limits the furnace on the inside.

Special measures are to be taken at the furnace inlet and outlet of such a furnace to prevent microwaves from escaping. So-called "microwave traps," which are designed as a "door" according to FR-A 0 911 170, have been known for this purpose. However, even if these "microwave traps" are used, the door must be opened from time to time to feed in new products or to remove the products from the heating chamber, and an undesired escape of microwaves may thus occur. In addition, these measures make such a furnace expensive.

The basic object of the present invention is to design a device of the class described in the introduction such that possibly optimal utilization of the microwave energy within the heating chamber is guaranteed, especially even in continuously operating furnaces and regardless of the shape and size of the products to be treated.

The present invention is based on the discovery that this object can be accomplished in an astonishingly simple manner by a special design and geometric arrangement of reflecting surfaces for the microwaves within the heating chamber.

The present invention is based on the consideration of designing and arranging corresponding reflecting surface(s) such that the microwaves coupled to the heating chamber via a device are reflected exclusively in the space limited by the reflecting surface(s), so that optimal utilization of the microwave energy can be achieved, while corresponding losses are avoided.

In its most general embodiment, the present invention specifically suggests for this a device of the class described in the introduction, in which the reflecting wall has, when viewed from the interior space of the heating chamber, at least two concave curved sections, which are arranged such that the microwaves coupled in via the device are reflected exclusively in the space limited by the reflecting wall.

The partial feature of a concave curvature of the reflecting wall is of particular significance, because the reflecting wall can thus be designed, especially in a continuously operating furnace, such that microwaves reflected in the direction of the inlet and outlet of the furnace are also reflected back and cannot escape via the furnace inlet and outlet.

In other words, the reflecting wall used to reflect the microwaves in the device according to the present invention is designed such that the microwave radiation components move at best along the plane defined by the furnace inlet and outlet, and the microwaves are thus prevented from escaping from the corresponding openings, or their escape is at least extensively reduced. The microwave radiation components are reflected by the reflecting wall such that they extend or move essentially in parallel to the surface of the opening at the inlet or outlet, e.g., in a continuously operating furnace.

However, the design according to the present invention also offers essential advantages for non-continuously operating furnaces insofar as areas of high energy densities can be specifically set via the reflecting wall, and the products to be treated are preferably arranged in these areas of the heating chamber or pass through the heating chamber in these areas.

According to one embodiment, the reflecting wall may be divided into a plurality of wall sections arranged at spaced locations from one another. It is possible to arrange the wall sections symmetrically to one another, as it specifically appears from the following description of the figures.

If the position of the wall sections in relation to one another is made adjustable, the areas of highest energy density can be set individually in the same furnace on a case-by-case basis, e.g., depending on the size of the products to be treated.

The division of the reflecting wall into a plurality of wall sections arranged at spaced locations from one another may be performed in various manners, especially in a continuously operating furnace, e.g., a tunnel furnace:

A continuously operating furnace is usually divided into different zones, e.g., a pre-heating zone, a firing zone, and a cooling zone. These may pass directly over into each other, or they may extend at spaced locations from one another. The reflecting wall may correspondingly be divided into a plurality of wall sections both within one zone and between the individual zones.

Thus, the pre-heating zone may be formed by, e.g., three reflecting wall sections arranged at spaced locations from one another, while the firing zone has a single reflecting wall, e.g., in the manner of a "cylinder," and the cooling zone is again designed analogously to the pre-heating zone.

However, viewed from the interior space of the treatment chamber, the reflecting wall(s) always has/have concave surface sections to prevent the undesired transfer of microwaves from one zone to the next or from the pre-heating and cooling zones into the environment.

The reflecting walls are designed for this purpose as, e.g., "inwardly arched" reflecting walls at the furnace inlet and furnace outlet.

The reflecting walls are always arranged depending on the direction of the microwaves coupled in to ensure reflection exclusively in the area of the reflecting walls.

In one embodiment, the present invention provides for associating a separate device with each furnace zone to couple the microwaves, and/or for making, if necessary, the output and/or the operating time of the microwave generators associated with the heating chamber or its zones controllable. Depending on the products to be treated, it is thus possible to set, e.g., a highly accurate temperature profile in the direction of conveying of the products in a continuously operating furnace.

It is also possible to arrange individual zones of the heating (treatment) chamber at spaced locations from one another, e.g., to provide for separate treatment steps for the products between the zones. It is possible in this case to arrange, e.g., a glazing station between individual zones in the case of the heat treatment of porcelain.

The device may, of course, also be designed such that it is used exclusively for drying or sintering products.

It was found in connection with the heat treatment of ceramic products that these can be heated particularly advantageously by microwaves if they are exposed to microwaves of a frequency that comes as close as possible to the natural frequency of the ceramic products.

The natural frequency of, e.g., porcelain is about 400 GHz. Frequencies markedly exceeding 2.45 GHz are needed to fire or sinter these products. Good results are obtained even at a frequency of about 28 GHz. The most economical results can be obtained with microwave frequencies between 200 and 400 GHz.

A marked reduction in the treatment time is always achieved in the case of microwave heating compared with prior-art furnaces heated with fossil fuels or electricity. Due to the gentle heat treatment, it is also possible, e.g., in the case of ceramic products, to apply a glaze prior to the firing or sintering and to produce the products in a heat treatment step.

Other features of the present invention are described in the subclaims as well as the other application documents.

Figure 2:
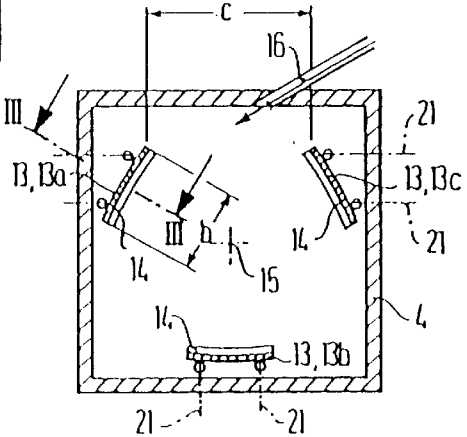
Figure 5:
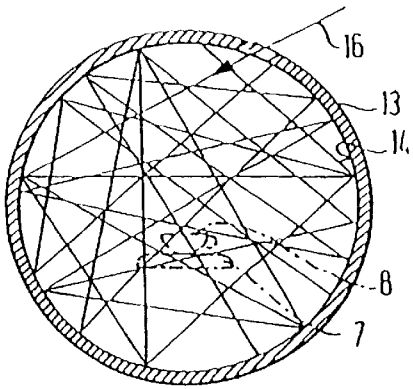
Figure 4:
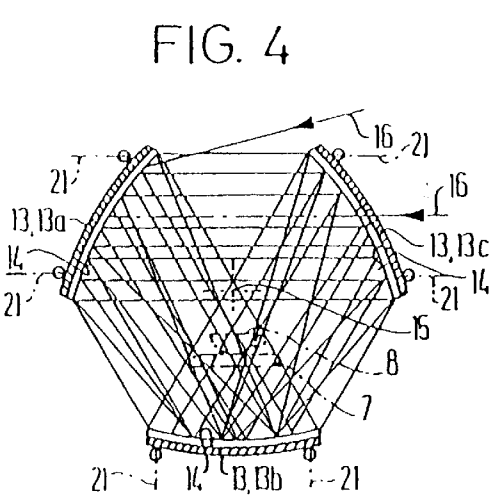
Figure 3:
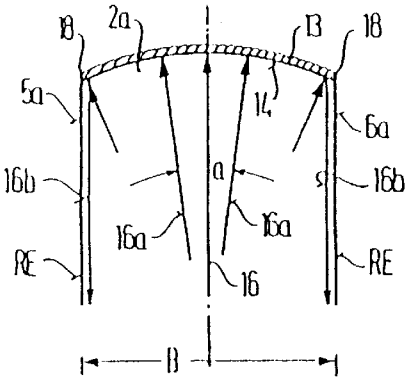

The present invention will be explained in greater detail below on the basis of various exemplary embodiments; in highly schematic representation, FIG. 1 shows a side view of a device designed as a continuously operating furnace, FIG. 2 shows a vertical longitudinal section through the device according to FIG. 1, FIG. 3 shows a section along line III—III according to FIG. 2, FIG. 4 shows an alternative embodiment for the arrangement of reflecting wall sections, and FIG. 5 shows another alternative embodiment of the design of a reflecting wall.

The device designated by reference number 1 in FIG. 1 is a continuously operating microwave furnace according to the present invention, in which the products to be conveyed, here porcelain, are conveyed on a conveying device 7 in the direction of conveying (arrow 3) from a furnace inlet 5 to a furnace outlet 6 through a heating chamber 2.

The heating chamber 2 is divided into four heating zones 2*a–d*, which are arranged one behind the other in the direction of conveying 3 and have, according to FIG. 2, an approximately square cross section, which is limited by an insulated housing 4.

The areas arranged between the zones 2*a–d* (shown by broken lines) may be associated with the zone arranged before or after them or form "free zones" to subject the products to special process steps.

The conveying device 7 comprises a roller conveyor, on which plates are arranged, on which the products are placed.

The conveying device 7 comprises a material, here plastic, which is permeable to microwaves.

The individual zones 2*a–d* as well as the conveying device 7 are connected to a central unit 9 via regulating/control lines. A microwave generator 11 (magnetron), which is connected to the corresponding heating zone 2*a–d* by a microwave-coupling device 12, is associated with each zone 2*a–d*. The microwave generators 11 and the coupling devices 12 are located in the cover (ceiling) area of the corresponding heating zones 2*a–d* here. FIG. 2 shows that the coupling device 12 is led through the corresponding cover.

The shape and design of the individual heating zones is identical in this exemplary embodiment and will be described in greater detail below on the basis of the heating zone 2*a*.

As is shown in FIG. 2, three reflecting wall sections 13*a–c* made of a microwave-permeable material, here metal, are arranged within the heating zone 2*a*, essentially symmetrically at an angle of 120° in relation to one another. When viewed from the interior space of the heating chamber 2*a*, the wall sections 13*a–c* are curved concavely in two directions, namely, in parallel to the direction of conveying 3 and at right angles to the direction of conveying 3 between the end areas. It follows from this that—when viewed in the direction of conveying 3—the wall sections 13*a–c* converge at the front and rear ends with the corresponding curved sections. The shape is thus similar to that of a concave mirror.

The microwaves are sent into the heating chamber 2*a* scantly as a bundled beam 16 via the device 12. The bundled beam 16 is shown in greater detail in FIGS. 2 and 3. The (concave) curvature of the wall sections 13*a–c* is designated by the reference number 14, and the shape and size of the curvature 14 are selected to be such that the microwave radiation components reflected on the wall sections 13*a–c* move within two radial planes RE located at an axial distance B from one another at right angles to the central longitudinal axis 15 of the heating chamber 2*a* and extend at right angles (perpendicularly) to the central longitudinal axis 15 and in parallel to the radial planes RE in the area of these radial planes RE. As a result, the radiation components are prevented from escaping behind the planes limiting the heating chamber 2*a* on the inlet side and on the outlet side (viewed in the direction of conveying 3). Aside from small, inevitable leakage radiation, the radiation components and consequently the microwave energy thus remain "captive" in the heating chamber 2*a*, without a need for additional measures, such as "partitions" or "doors." The design according to the present invention also prevents radiation components from entering adjacent heating chambers and distorting the local conditions there.

The following additional comment shall be made concerning the shape and size of the curvature 14: Taking into account a technically inevitable, small leakage of the beam 16 with the scattering angle a shown schematically in FIG. 3 between the radiation components 16*a*, a scattering angle (not shown) with outer reflected radiation components 16*b* is also obtained for the reflected radiation components 16*a*. If the shape and size of the curvature 14 are selected to be such that the reflected radiation components 16*b* extend approximately at right angles (perpendicularly) to the central longitudinal axis 15 and in parallel to the radial planes RE at the lateral edges 18 of the wall section 13*a–c*, an axial escape of the radiation components 16*b* is extensively prevented, and the desired goal, namely, the inclusion of the essential amount of the radiation components in the heating chamber 2*a*, is achieved. As is shown in FIG. 5, the reflecting wall 13 may also have a cylindrical shape, in which case concave, inwardly extending curved sections are provided at least at the front-side ends.

It is advantageous, as is shown in FIG. 4, to design the wall sections 13*a–c* as concavely curved wall sections at right angles to the direction of conveying 3, i.e., in the circumferential direction, as a result of which the concentration of the microwaves on the cross section of the heating space is improved and a homogeneous field distribution of the microwave energy is made possible.

In the case of the closed reflecting wall shown in FIG. 5, the reflection leads to a distribution of the radiation components over the entire cross section of the corresponding heating space.

This can also be achieved if the dimension b of the wall sections 13*a–c* extending in the circumferential direction is selected to be so great, taking into account the resulting reflection angle, that the inner radiation components 16 extend in the area of the central longitudinal axis 15.

It is advantageous for the purpose of a homogeneous distribution of the microwave energy density to provide the wall sections 13, 13*a–c* with grooves and webs (not shown), which extend in the direction of the central longitudinal axis 15 and whose flanks are designed such that they bring about a homogeneous field distribution by reflection directed at right angles to the central longitudinal axis 15 within the desired irradiation field.

The fastening of the wall sections 13*a–c* is not specifically shown. The fastening may be performed, in principle, in any desired manner. The fastening should advantageously be such that the position of the wall sections 13*a–c* be adjustable. Adjusting and fixing elements 21 with corresponding joints are schematically shown in FIGS. 2 and 4. The fastening elements are fixed with their other end on a frame 4 or they are guided by the frame 4, so that they can be manipulated from the outside.

In the exemplary embodiment according to FIG. 4, the conveying device 7 is arranged eccentrically, namely, it is offset in the direction of the lower wall section 13*b* to the extent that the products 8 are placed in the area of the heating chamber with the highest energy density.

The following functions may be assigned to the heating chambers 2*a–d* in the furnace schematically shown in FIG. 1:

2*a*: Pre-heating zone
2*b*: Additional pre-heating zone
2*c*: Firing/sintering zone
2*d*: Cooling zone.

The above-described division is given purely as an example and may be changed as desired. Thus, it is also possible to arrange, e.g., glazing zones between individual zones to make it possible to also produce glazed products in a single operation.

I claim:

1. Device for heat-treating products (8) by microwave radiation, said device including a heating chamber (2) for accommodating the said products (8), wherein microwaves (16) can be coupled into the said heating chamber (2) by a device (12), and the said heating chamber (2) has at least one reflecting wall (13) reflecting the said microwaves (16), wherein the said reflecting wall (13) is divided into a plurality of wall sections (13*a–c*) arranged at spaced locations from one another, and the said wall sections (13*a–c*) have—when viewed from the interior of the said heating chamber (2)—at least two concave curved sections (14), which are arranged such that the microwaves coupled in via the said device (12) are reflected exclusively within the space limited by the said reflecting wall (13), in which the wall sections (13*a–c*) are arranged symmetrically to one another, in which the positions of the wall sections (13*a–c*) in relation tc one another are adjustable, with a tunnel-shaped heating chamber (2), (2*a–d*), having an inlet end (5) and an outlet end (6), through which the products (8) can be conveyed on a conveying device (7) between the inlet end and outlet end (5, 6), in which the heating chamber (2, 2*a–d*) is divided into a plurality of zones (2*a–d*) arranged one behind the other in the direction of conveying (3) of the products (8), and each of said zones being provided with at least one individual reflecting wall (13, 13*a–c*), in which a separate device (12) for coupling in the microwaves is associated with each zone (2*a–d*), in which the power and/or the operating time are controllable by microwave generators (11) associated with the heating chamber (2) or its zones (2*a–d*), in which at least two zones (2*a–d*) of the said heating chamber (2) are arranged at spaced locations from one another, and in which the conveying device (7) is arranged such that the products (8) conveyed on it pass through the area of the highest microwave energy density.

* * * * *